US005638803A

United States Patent [19]

Chang

[11] Patent Number: 5,638,803

[45] Date of Patent: Jun. 17, 1997

[54] OILING CONTROL DEVICE FOR REMOTE-CONTROL MODEL ENGINE OIL TANK

[76] Inventor: Chi-hsin Chang, No. 9, Alley 1, Lane 192, Sec. 1, Ming Sheng Rd., Ta Ya Hsiang Taichung Hsien, Taiwan

[21] Appl. No.: 516,878

[22] Filed: Aug. 18, 1995

[51] Int. Cl.[6] ..... F02M 25/07

[52] U.S. Cl. ..... 123/676; 123/DIG. 3

[58] Field of Search ..... 123/196 R, 73 AD, 123/DIG. 3, 196 CP, 676

[56] References Cited

U.S. PATENT DOCUMENTS

| | | | |
|---|---|---|---|
| 2,764,139 | 9/1956 | Gordon | 123/DIG. 3 |
| 3,734,072 | 5/1973 | Yamda | 123/DIG. 3 |
| 5,488,933 | 2/1996 | Pham | 123/DIG. 3 |

*Primary Examiner*—Erick R. Solis

*Attorney, Agent, or Firm*—Bacon & Thomas

[57] ABSTRACT

The present invention relates to a fueling control device for a remote-control model to prevent fuel oil overflow and to stop fueling automatically by sensing fuel oil delivery pressure. The device has a check valve, a pump and a control device with an electronic control consisting of a DC power supply circuit, a voltage regulation circuit, a switch type voltage regulation circuit, a control key, a CPU, a differential current inspection circuit, a motor circuit, and a motor driven pump. The check valve is connected between the fuel oil tank and an air conduit connected to a muffler. The pump is connected between a fuel oil drum, and a fuel oil delivery tube for pumping fuel oil from the fuel oil drum into the fuel oil tank. When the fuel oil tank is filled, overflow fuel oil causes closure of the check valve to cause a sudden rise of fuel oil delivery pressure. The rising load on the motor is transmitted to the control device to cause the pump to stop running.

3 Claims, 8 Drawing Sheets

OILING CONTROL DEVICE FOR REMOTE-CONTROL MODEL ENGINE OIL TANK

BACKGROUND OF THE INVENTION

There are a wide variety of remote-control model toys such as airplanes, race cars, beach cars, speed boats, etc. Because they are a small copy of the real object, they have high fidelity and use engines as the source of power. With high speed and a small size that makes easy for storage, they are widely popular.

However, before use, their fuel oil tank 10 must be filed in full as shown in FIG. 1. The connections between the engine 30 and fuel oil tank 10 of a remote-control model toy comprises an air duct 11 of fuel oil tank 10 connected to an air conduit 12 on the pressure port 21 of muffler 20. When the engine 30 starts running, the exhaust passes into fuel muffler 20, and a portion of the exhaust will be discharged into fuel oil tank 10 by means of pressure port 21 through air duct 12 and air conduit 11 to increase the pressure therein. Pressurized fuel oil in the auxiliary tank 10 will flow into a carburetor 31 by means of fuel oil intake 310 of the engine 30 from the fuel oil inlet 13 through fuel oil tube 14. Such design increases force against the fuel oil in the fuel oil tank 10 when the carburetor 31 is in action, whereby the gas discharged by the engine 30 from the muffler 20 into the fuel oil tank 10 may help deliver fuel oil into the carburetor 31 so as to make up for insufficient suction force of the carburetor 31. Using exhaust pressure to substitute for an "oil pump" function, not only reduces the size and weight but also lowers production costs. For filling the fuel oil tank 10, the fuel oil tube 14 has to be withdrawn from the fuel oil intake 30 of the carburetor 31, and a fuel oil bottle 80 is used for sucking fuel oil from the fuel oil drum 81. Fuel oil can be gradually fed through the fuel oil tube 14 by squeezing fuel oil bottle 80. Fueling in such a way is slow and causes waste of time. Further, fuel oil might leak out when the fuel oil bottle 80 is sucking fuel oil or delivering fuel oil so that it may cause waste of fuel oil and pollution on the user's hand. Because the fuel oil tank 10 cannot be observed, the user cannot discover if the fuel oil tank is full until fuel oil often flows into the muffler 20 through conduit 12. Therefore, it has the following defects:

1. When fuel oil overflows through the air conduit 12, fuel oil in the fuel oil tank 10 has flowed into the muffler 20 through pressure port 21 and air conduit 12 to cause the waste of fuel oil.

2. Because the combustion point of fuel oil is low, fuel oil leaked into the muffler 20 has the risk of ignition owing to the rising temperature of the muffler 20.

3. When overflow fuel oil flows back to the cylinder of the engine 30 from the muffler 20, the spark plug will become wet making the engine 30 difficult to start.

4. Upon completion of fueling, fuel accumulated in the engine 30 cylinder must be cleared away in order to start the engine smoothly. If not cleared away, residual fuel oil will result in "hydraulic compression" due to excess of fuel oil in the piston when mixing with air in the compression cylinder.

Because compression of fuel oil is limited, the piston will be stuck in the cylinder. Forcibly moving the piston may cause the piston links to be bent and damaged.

SUMMARY OF THE INVENTION

In view of the aforesaid defects of conventional fueling, such as slow speed and fuel oil overflow, the inventor therefore has devoted himself to research, and has mounted a check valve 70 in the air conduit 12 for preventing fuel oil overflow from entering the muffler 20, and uses a pump 40 for pumping fuel oil into the fuel oil tank 10 from the fuel oil drum 81. When the fuel oil tank is filled up, fuel oil will flow into the check valve 70 through air conduit 12 to close the port with the fuel oil plug 73 to avoid fuel oil overflow and to increase pressure of the fuel oil. The pump 40 will stop running because of a fuel oil pressure signal produced by the sensor sensing the closing of check valve 70. When the fuel oil tube 14 is connected to the carburetor 31, fuel oil will flow back to the fuel oil tank 10 so that the check valve will resume its venting function so as to overcome the defects of conventional fueling.

DETAILED DESCRIPTION OF THE PREFERRED EMBODIMENTS

Figure 1:
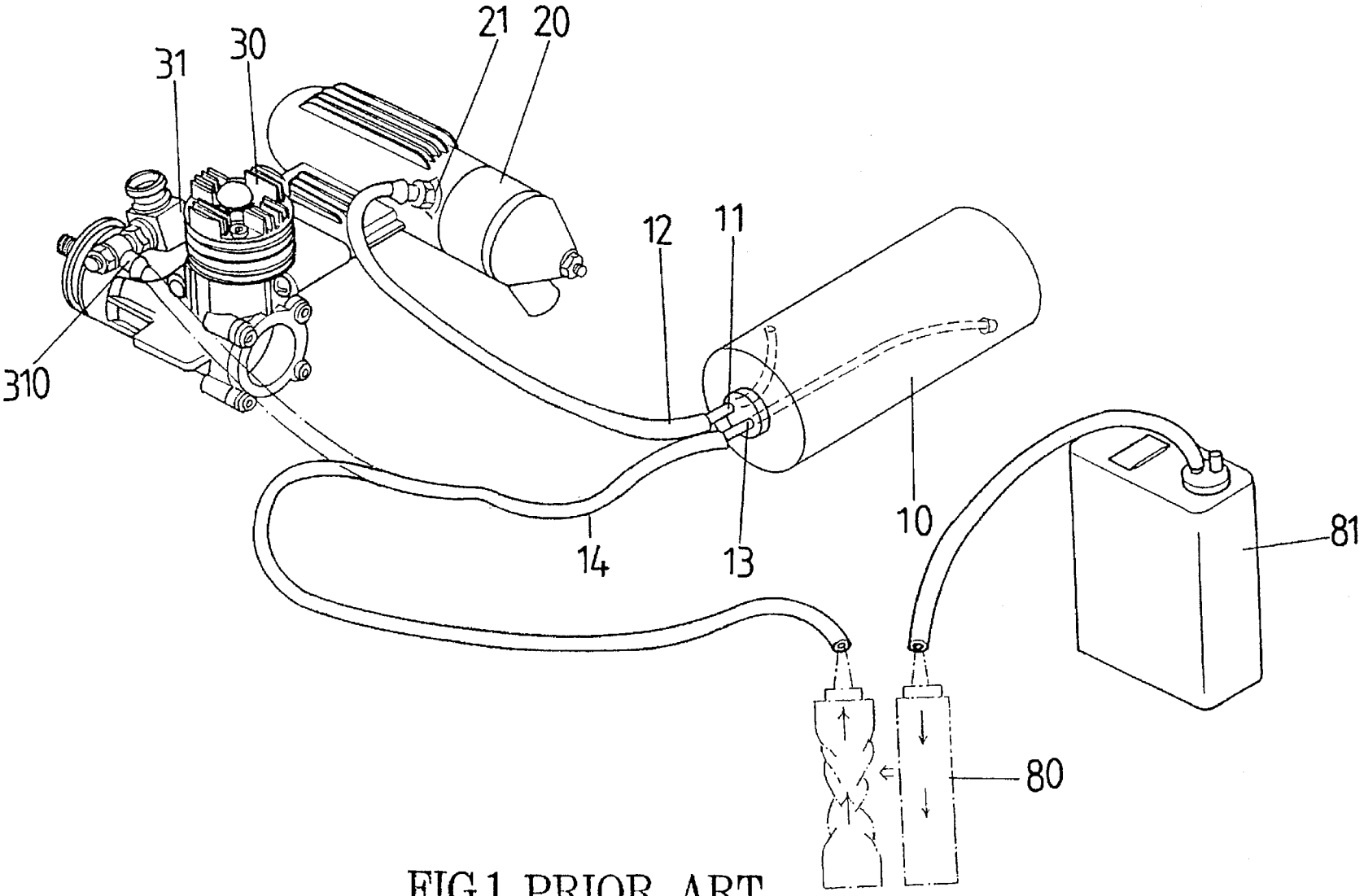
FIG.1 PRIOR ART
FIG. 1 is a diagrammatic perspective view showing the fuel oil line and fueling of a conventional fuel oil tank.
Figure 2:
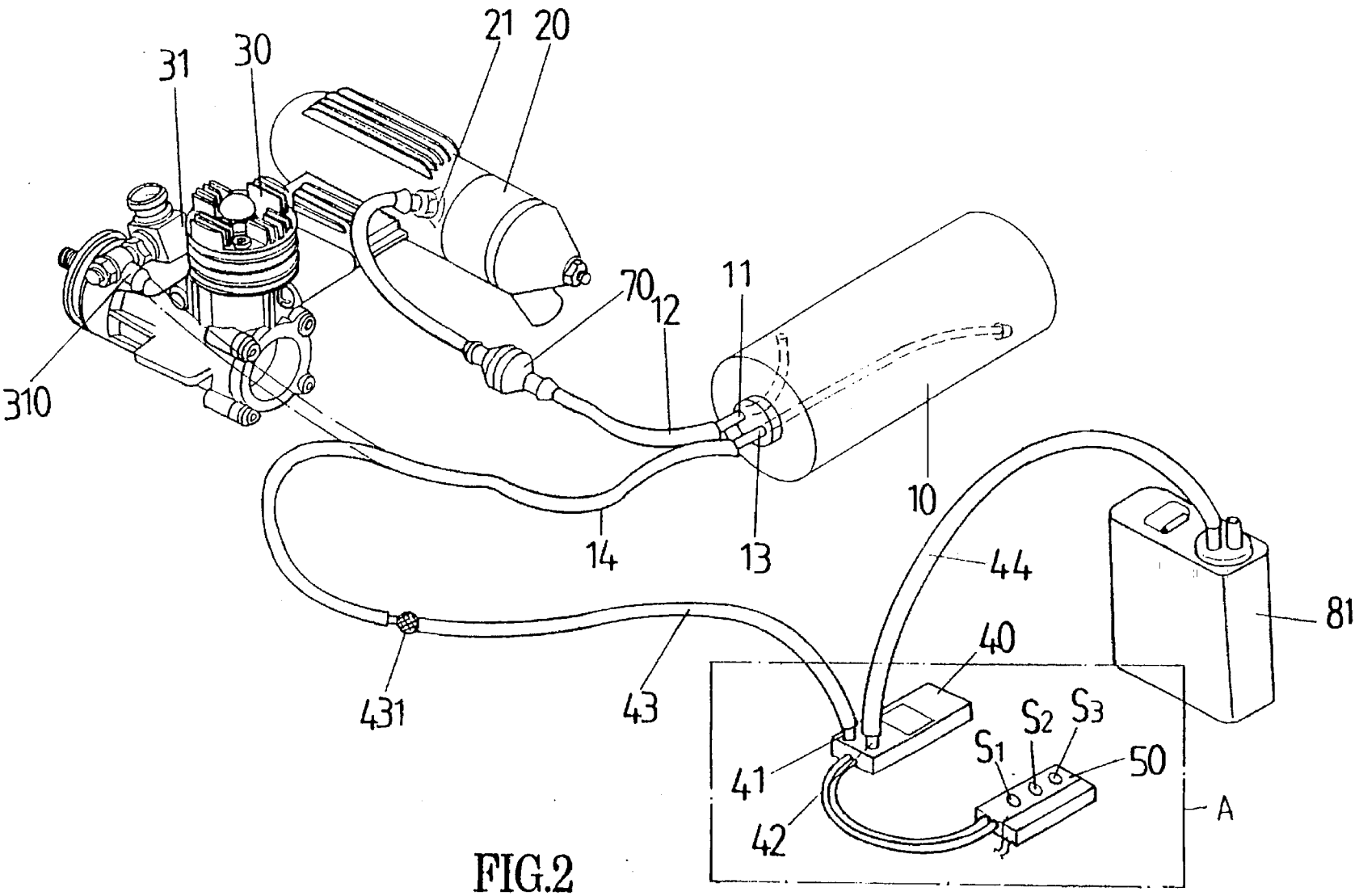
FIG. 2 is a diagrammatic perspective view showing the fuel oil line and fueling according to the present invention.

Referring to FIG. 2, the present invention comprises a check valve 70, a pump 40 and a fueling control device A consisting of sensor 50. Said check valve 70 is mounted in the air conduit 12 connecting the pressure port 21 to the fuel oil tank 10 so that said check valve 70 is connected to said air conduit 12. The pump 40 is connected with the sensor 50 to form a fueling control device A. The pump 40 may feed fuel oil into the fuel oil tank 10 from the fuel oil drum 81 through the connector 431. When the fuel oil tank 10 is filled up, the feedback of fuel oil pressure to the pump 40 may control the action of the pump 40 by means of controller 50.

Figure 3:
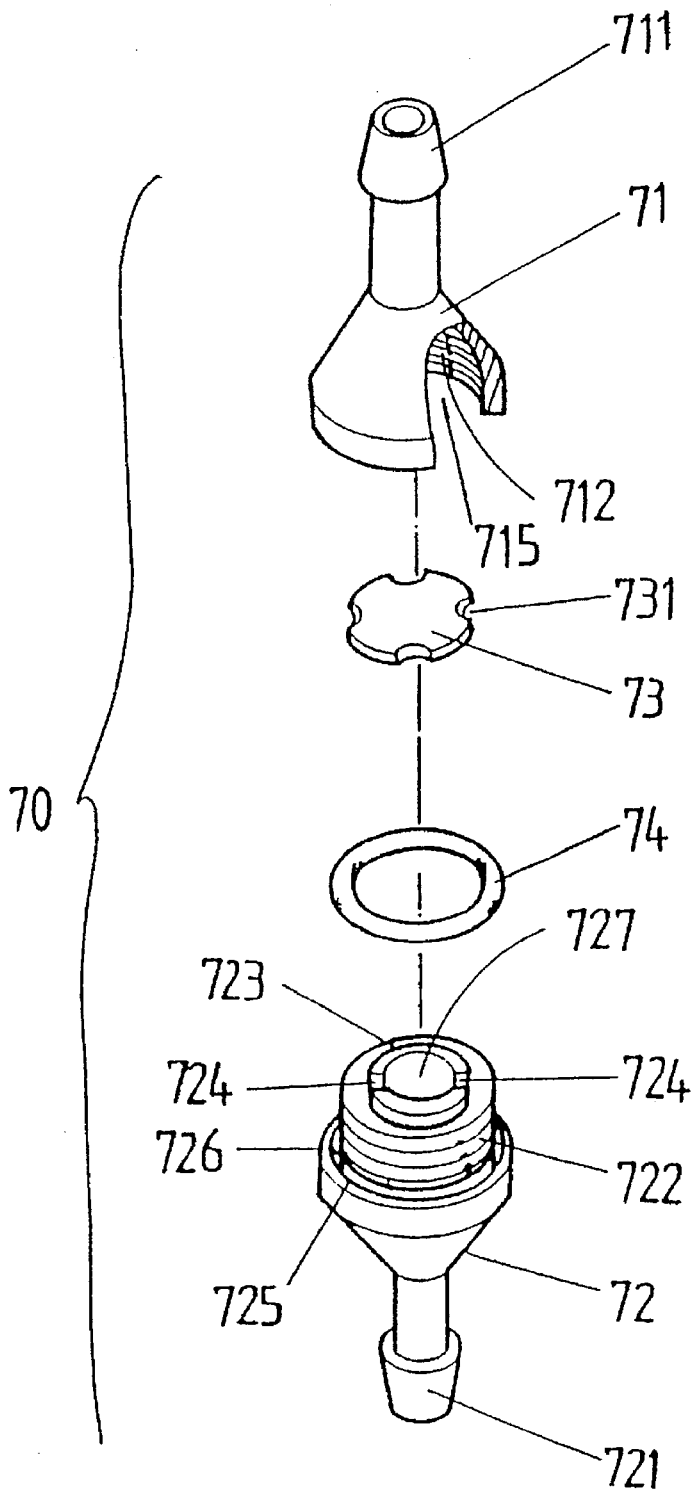
FIG. 3 is an exploded perspective view showing the check valve of the present invention.
Figure 4A:
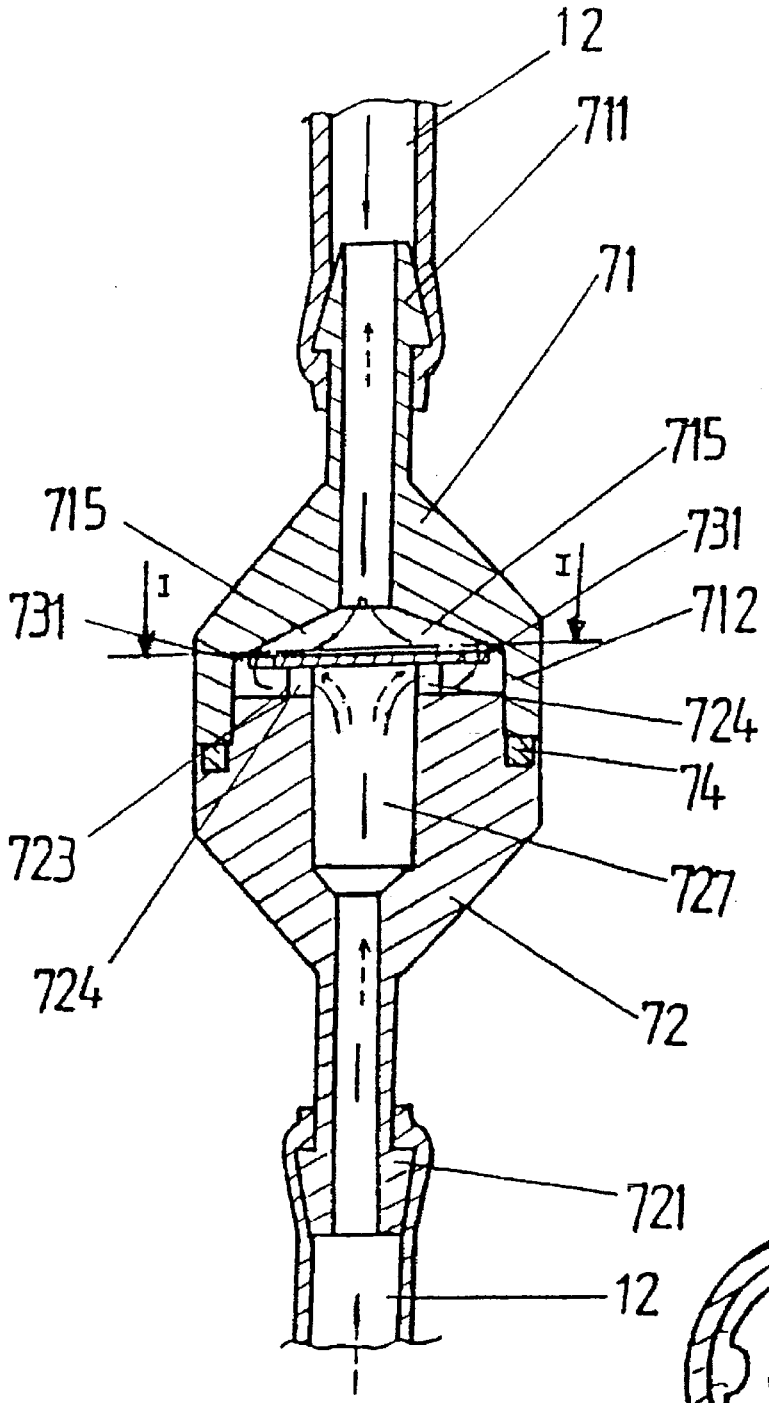
FIG. 4A is a cross-sectional view of the check valve of the present invention.
Figure 4B:
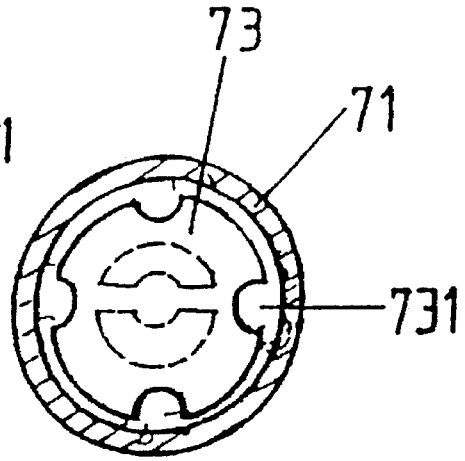
FIG. 4B is a cross-sectional view taken along line I—I in FIG. 4A.

Referring to FIGS. 3, 4A and 4B, the check valve 70 comprises a symmetrical hollow upper and lower main bodies 71, 72, fuel oil plug 73, and O ring 74. Said upper main body 71 forms an accommodating space 715 therein, and on one end has a connector 711. The internal ring rim of the accommodating space 715 has threaded portion 712. The lower main body 72 has a main flow tube 727, and one end has a connector 721. The other end has external threads 722 corresponding to the thread portion 712 of the upper main body 71, and on the end of said external thread 722 is a flange 723. A side of said flange 723 is cut with a horizontal vent slot 724. The top edge 725 of the external thread 722 has a ring slot 726 for receiving O ring 74 therein.

The oil plug 73 is made from flexible silicon, resembling a round sheet, with the perimeter having a plurality of vent slot openings 731.

Referring to FIGS. 4A and 4B, said oil plug 73 is mounted in the accommodating space 715 of the upper main body 71, and the external thread 722 of the lower main body 72 is screwed into the threaded portion 712 of said upper main body 71, such that the flange 723 of the lower main body 72 is in contact with the bottom of said oil plug 73, and the end of upper main body 71 may tightly push against the O ring 74 on the top edge 725 of the lower main body 72 to prevent leakage. The connectors 711 and 72 on each end are put into the air conduit 42, therefore, each end of check valve 70 may communicate with each other via the vent slot 724 of the flange 723 and the vent slot openings 731 of oil plug 73.

Referring to FIGS. 2, 4A and 4B, the check valve 70 is connected in the air conduit 12. The carburetor 31 may produce a suction force for sucking fuel oil from the fuel oil tank 10 by means of fuel oil tube 14 (not strong) when the engine 30 starts running. The air stream discharged by the engine 30 into the muffler 20 will flow into the air conduit 12 by virtue of pressure port 21 to enter the upper main body 71, through vent opening 731, into the vent slot 724 beside the flange 723 of the lower main body 72 and into the main air tube 727 of the lower main body 72 for passage into the fuel oil tank 10 by virtue of air conduit 12 to help pressurized fuel oil to flow into the carburetor 31. Therefore, air can pass into the fuel oil tank 10 without obstruction. Likewise, air in the fuel oil tank 10 when not used in the carburetor 31 can be delivered into the muffler (such as for oiling) so that the check valve 70 has a two-way venting function.

Figure 6:
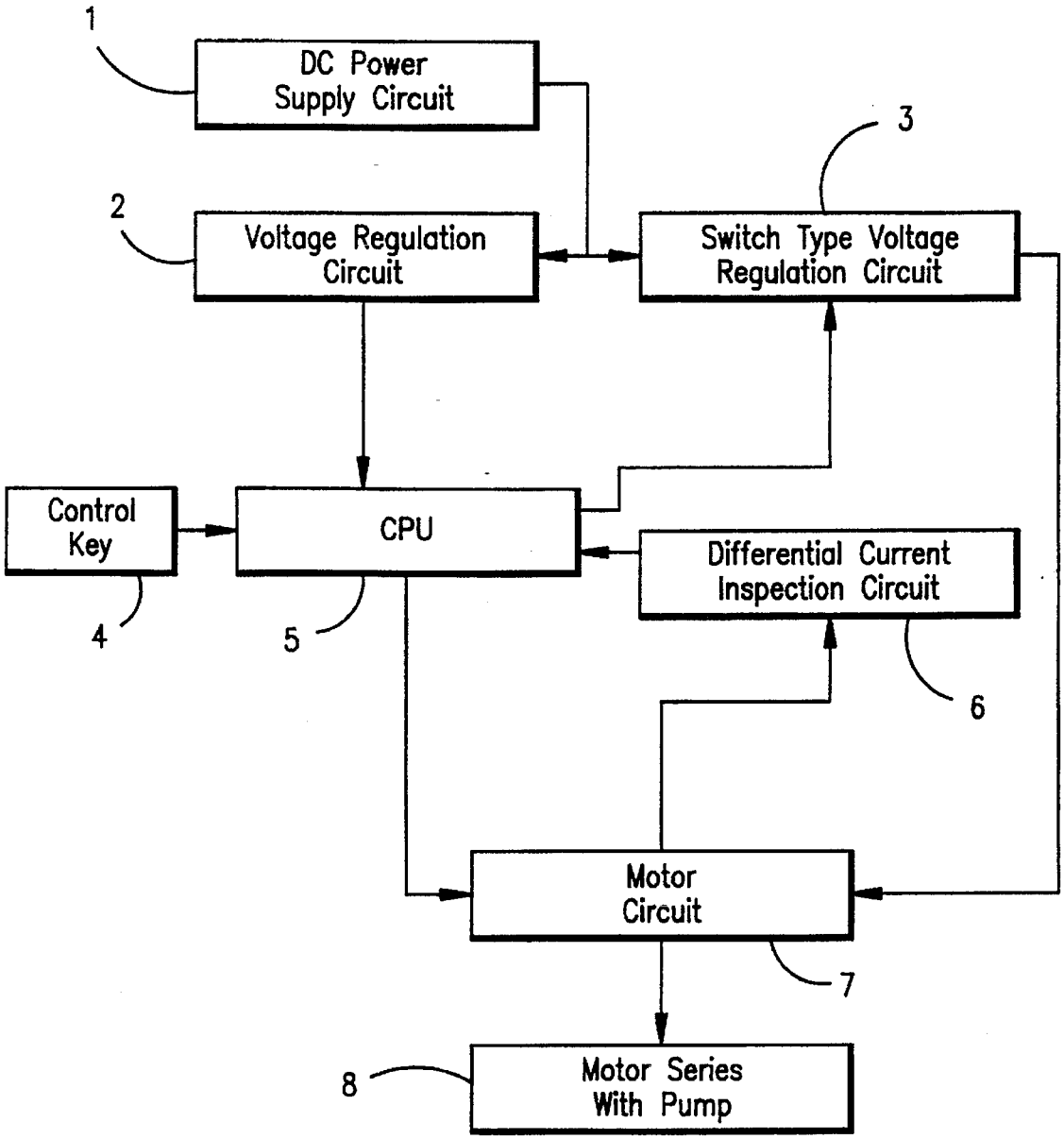
FIG. 6 is a block diagram showing the control process of the present invention.
Figure 7:
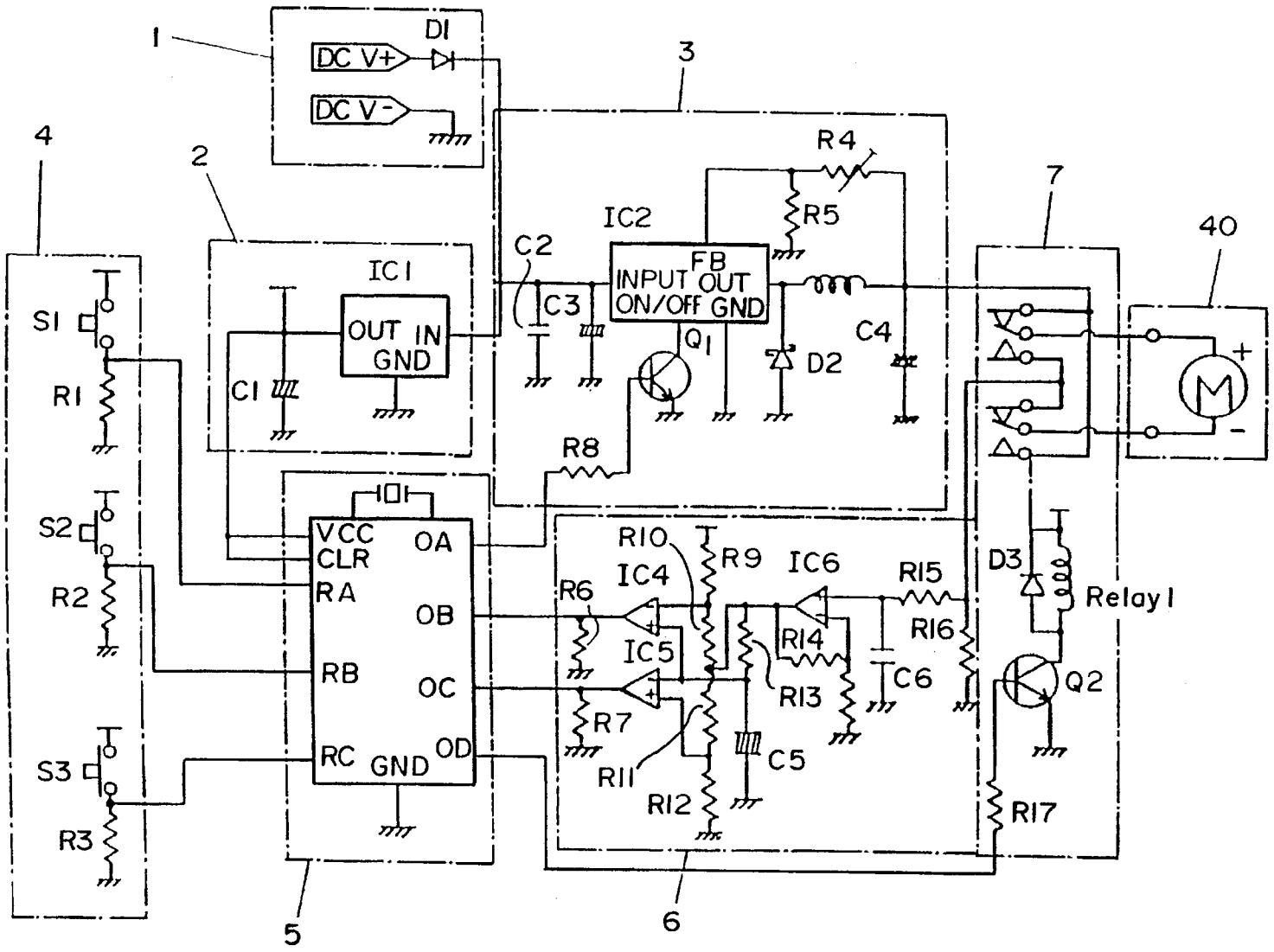
FIG. 7 is a schematic diagram of the control circuit of the present invention.

The control device A comprises sensor controller 50 and pump 40 (FIGS. 6, 7) wherein the circuit of said sensor controller 50 comprises DC power supply circuit 1, voltage regulation circuit 2, switch type voltage regulation circuit 3, control key 4, CPU 5, differential current inspection circuit 6, motor circuit 7, motor M connected with pump 40, wherein said switch type voltage regulation circuit 3 adjusts voltage by means of adjustable resistor R4 so as to adapt to the motor a different voltage to increase the suitability of the controller. Control key 4 is provided for key-in of a control signal for fueling, stop and pumping. Differential current inspection circuit 6 is a current comparator circuit for inspecting the signal of the loading current rise or drop of motor M. Motor circuit 7 comprises a relay for changing the direction of the motor running. Pump 40 has fuel oil outlet 41 and inlet 42 respectively connected to a fuel oil delivery tube 43 and a fuel oil feed tube 44. The end of said fuel oil delivery tube 43 has a connector 431 for connection with the fuel oil feed tube 14. Said oil feed tube 44 may be connected to the fuel oil drum 81. Said pump 40 connects with a controller 50, said controller 50 has a plurality of push buttons S1, S2, S3 for the control of pump operation subject to sensing the motor load in the pump 40.

Figure 5:
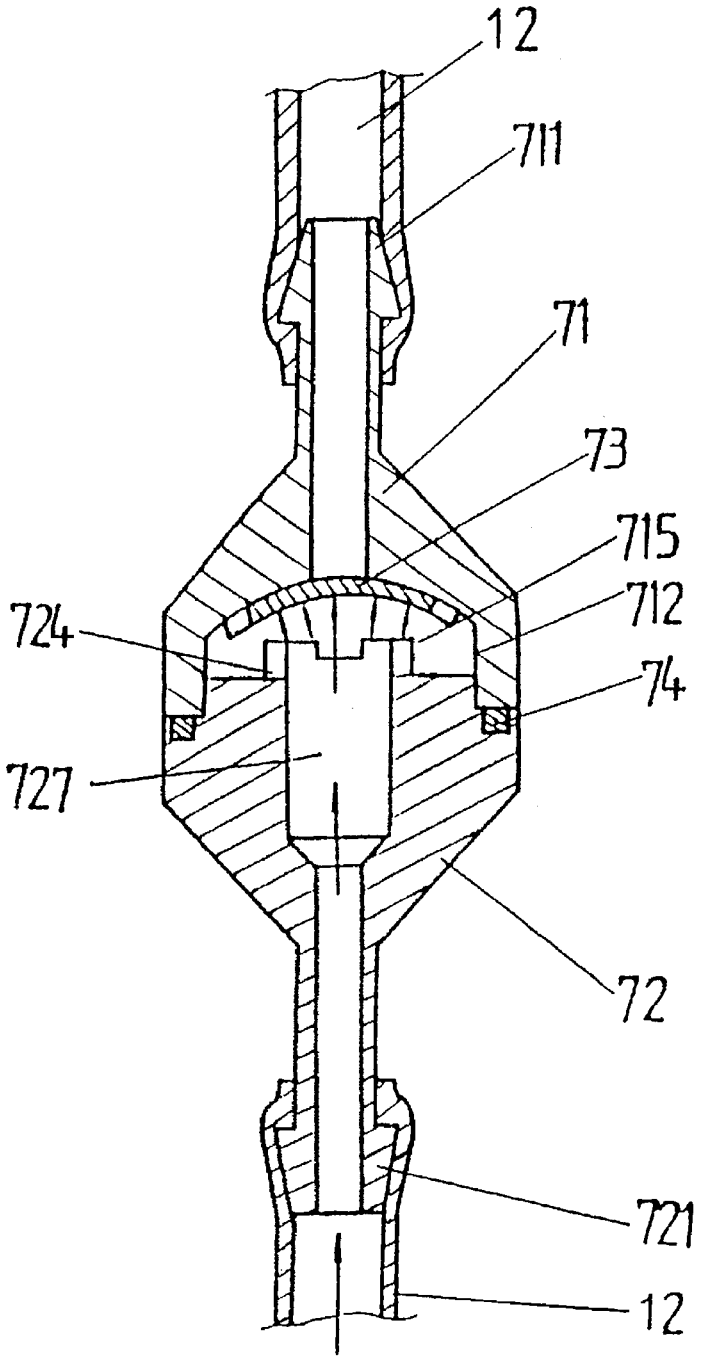
FIG. 5 is a cross-sectional view showing the action of the check valve of the present invention.

The control method of the present invention is described below (FIGS. 2, 3, 4, 5, 6, 7):

1. Automatic fuel oil feed and stop:

For fuel filling of the fuel oil tank 10, the pump 40 is connected to the fuel oil intake 310 of the carburetor 31, by withdrawing the fuel oil delivery tube 14 and connecting it to the fuel oil delivery tube 43 of pump 40. The other fuel oil delivery tube 44 of pump 40 is connected to the fuel oil drum 81. An action signal is entered into CPU 5 by means of push button S1 of control key 4 of controller 50. The CPU may send a control signal to the switch voltage regulation circuit 3 through resistor R8, transistor Q1, for enabling the switch voltage regulation circuit 3 to give voltage to the motor circuit 7, and the relay appears in the NC state to start the running of motor M of pump 40 (positive run) whereby fuel oil is delivered from the fuel oil drum 81 into the fuel oil tank 10. The motor M current appears at resistor R16 of differential current inspection circuit 6, and is filtered by the resistor R15 and capacitor C6, and amplified by IC6 and delivered to IC4, IC5 to form a window comparator for monitoring the motor M current value. When fuel oil is delivered into the fuel oil tank 10, air in the oil tank 10 will be reversed into the air conduit 12, through check valve 70, and will be discharged out of the muffler 20 by virtue of vent slot 724 on the flange 723 and vent slot openings 731 on fuel oil plug 73. Because pressure of reversal air flow is lower and air flow speed is faster, the air will push the oil plug 73 by means of the main vent tube 727 and will be swiftly discharged into the muffler 20 by means of vent slot 724 in flange 723 so that its force against fuel oil plug 73 is not enough to cause the plug 73 to choke up the bore of the accommodating space 715 so that air may flow into the muffler 20. When the fuel oil tank 10 is filled up, it is not easily ascertained through the appearance of the model. With pump 40 pressure, fuel oil may enter the air conduit 12 and pass into the main flow tube 727 of the lower main body 72 through the vent port 11. Because fuel oil concentration is far greater than air, the vent slot 727 beside the flange 723 and the vent slot openings 731 of fuel oil plug 73 are not enough to allow smooth discharge of fuel oil, fuel oil pressure increases for pushing the flexible fuel oil plug 73 of main air flow tube 727 for choking up the bore of accommodating space 715 of the upper main body 71. Referring to FIG. 5, partial fuel oil flowing into the accommodating space 715 of upper main body 71 above fuel oil plug 73 by means of the vent slot 724 of the flange 723 will not flow into the bore of accommodating space 715 of upper main body 71 until it is filled so that its speed is lower than the speed in the main flow tube 723 pushing up the fuel oil plug 73. Thus, when fuel oil fills up the accommodating space 715, the bore is choked by the fuel oil plug 73 to stop fuel oil from flowing. Pressure increases on the fuel oil plug 73 for increasing the choking effect. Because fuel oil is choked by the check valve 70 while the pump 40 keeps on running, fuel oil pressure in the air conduit 12, fuel oil tank 10 and fuel oil delivery tube 14 will be rising, and a pressure signal will be sent to the pump 40 to turn off pump 40. The load will be increasing because of motor M sensing pressure in the fuel oil delivery tube 14 and current will also be rising. The input end of IC5 of differential current inspection circuit 6 will undergo a slow voltage rise owing to the delay function of IC6, resistor R13, Capacitor C5, and direct input from resistor R11 and R12 will cause IC5 to send signal to OC end of CPU. The CPU causes the switch voltage regulation circuit 3 to stop motor M and terminate the fuel oil filling of the fuel oil tank 10.

Figure 8:
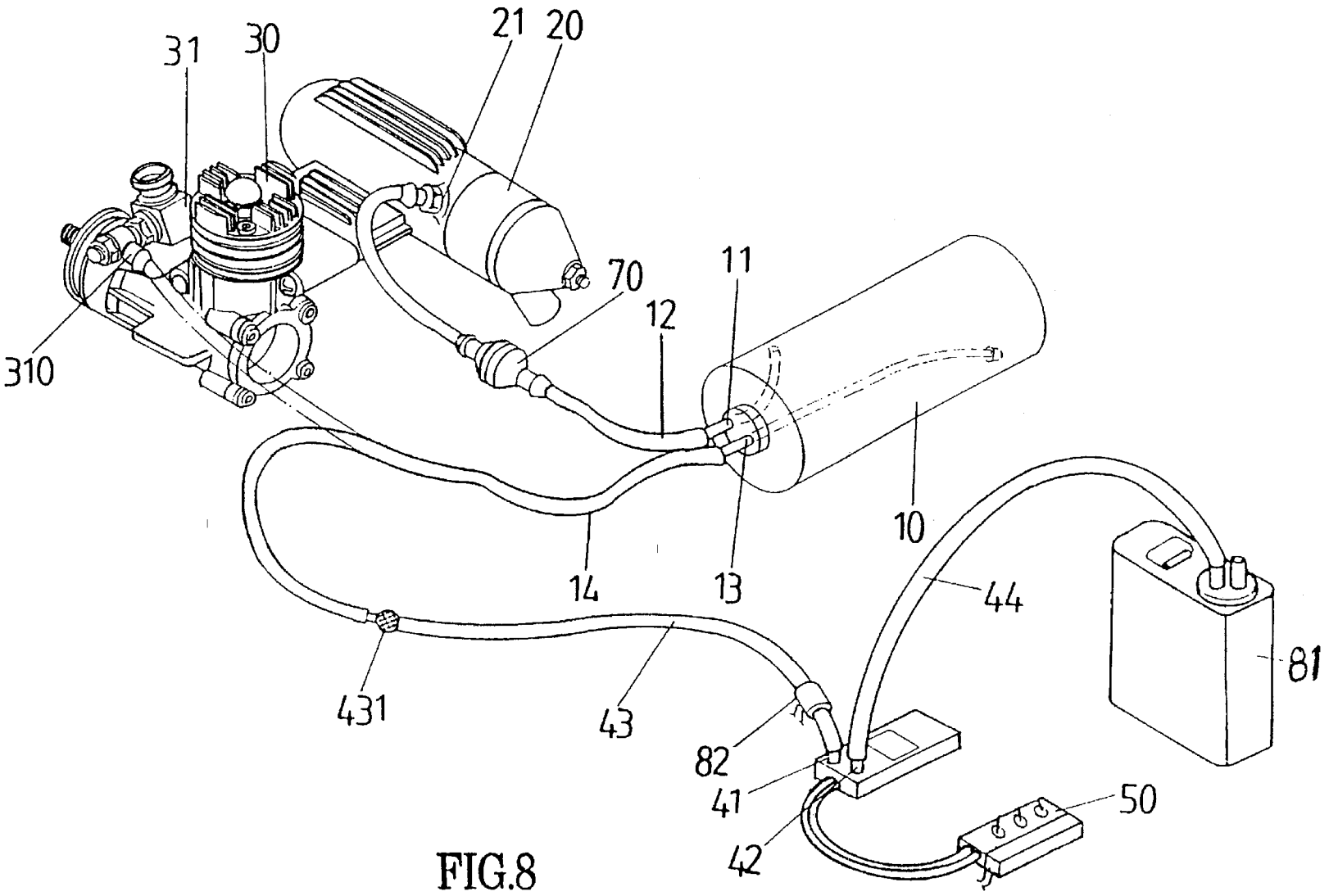
FIG. 8 is a diagrammatic perspective view showing a pressure sensor used with the present invention.

Referring to FIG. 8, another means of control is achieved by fuel oil delivery tube 14 (or fuel oil tank 10 or air conduit 12) having a pressure sensor 82 linked to the controller 50. When fuel oil pressure suddenly rises in the oil delivery tube 14 (or fuel oil tank 10 or air conduit 12), pressure sensor 82 will issue an oil pressure signal and transmit it to the controller 50 to stop pump 40 from running.

Therefore, when fuel oil delivery tube 14 is connected back to the carburetor 31, fuel oil in the fuel oil tank 10 will lose pump 40 pressure, and partial fuel oil will return to the fuel oil delivery tube 14. When fuel oil delivery tube 14 is connected back to the fuel oil intake 311 of the carburetor 31, fuel oil in the check valve 70 will return to the fuel oil tank by through air conduit 12 so that the fuel oil plug 73 will recover without pushing by fuel oil. Therefore fuel oil will not overflow into the muffler 20 nor return to the engine 30 to avoid the risk of ignition or starting problems. A portion of the air in the muffler 20 will flow into the air conduit 12 to compress residual fuel oil in the air conduit 12 into the fuel oil tank 10 when the engine starts so that check valve 70 and air conduit 12 can be two-way venting to stop oil from flowing out.

2. Critical stop of fueling:

If it is desired to stop fueling, key S2 is pushed to enter a control signal in the CPU which will send a signal to the switch voltage regulation circuit 3 to stop fueling.

3. Pumping fuel oil:

When the model is not to be used, fuel oil in the fuel oil tank 10 must be withdrawn to avoid fuel oil flowing to the engine to cause starting problems in the future. For pumping oil, key S3 is pushed to enter a signal into the CPU, which will send a signal to the switch voltage regulation circuit 3 to feed voltage to the motor circuit 7, and CPU 5 OD will send a signal to FC contactor to open by means of R17, Q2, relay 1 to cause motor M to reverse for pumping fuel oil out of fuel oil tank 10. Differential current inspection circuit 6 detects circuit current until fuel oil is withdrawn in full. Idle running of pump 40 motor M will cause lower load on the motor, and controller 50 will sense the change of load, i.e., current drops suddenly to cause IC4 to send a signal to the CPU to stop motor M.

I claim:

1. A fueling control device for a model having an engine with a carburetor and an exhaust, and a fuel oil tank with an air conduit and a fuel oil conduit, the device comprising:

a check valve connected between a pressure port of the engine exhaust and the fuel oil tank air conduit, and a control device connected between the fuel oil conduit of the fuel oil tank and a fuel oil supply, said control device comprising: a sensor controller and pump wherein a circuit of said sensor controller comprising a DC power supply circuit, a voltage regulation circuit, a switch type voltage regulation circuit, a control key, a CPU, a differential current inspection circuit, a motor circuit, and a motor connected to a pump connected to the fuel oil supply and to the fuel oil conduit, wherein: said switch type voltage regulation circuit adjusts voltage by means of an adjustable resistor so as to supply to the motor a variable voltage; said control key provides for key-in of a control signal to control operation of the motor;

said differential current inspection circuit, has a current comparator circuit for detecting a loading current rise or drop of said motor;

said motor circuit comprises a relay for changing the direction of motor running; whereby said control system has a first key S1 for fueling which when pushed causes the CPU to send a signal to enable the switch voltage regulation circuit and a signal to enable the pump motor for fueling by pumping fuel oil from the fuel oil supply to the fuel oil tank, said differential current inspection circuit monitoring an operating current, such that fuel reaching the check valve causes the check valve to close to cause rising of the pump motor load and load current, which is sensed by the differential current inspection circuit and sends a signal to the CPU to stop the motor running.

2. The fueling control device for a model as claimed in claim 1 wherein said check valve comprises an upper and a lower main body, a fuel oil plug, and an O ring; wherein said upper main body and said lower main body each have an end having a connector wherein:

the upper body forms an accommodating space therein, and has an internal ring rim of the accommodating space with a threaded portion;

the lower main body has a main flow tube, an end having external threads engaged with the threaded portion of the upper main body, the end having said external thread forming a flange, with a horizontal vent slot, and a top edge of the external threaded end having a ring slot for receiving an O ring therein;

said fuel oil plug configured in a round sheet and on a perimeter having a plurality of vent slot openings;

said fuel oil plug mounted in the accommodating space of the upper main body, and the external threaded end of the lower main body screwed into the threaded portion of said upper main body, whereby the flange of the lower main body contacts a bottom of said fuel oil plug, and the connector on each end connected in an air conduit extending between the exhaust and the fuel oil air conduit, whereby air on each end of check valve communicates with the vent slot of the flange by the vent slot opening of the fuel oil plug and whereby fuel oil delivered into the main flow tube of the lower main body to push the fuel oil plug to choke off the bore of accommodating space of the upper main body so that the check valve has a two-way venting function.

3. The fueling control device for a model as claimed in claim 1, further comprising a pressure sensor located in one of fuel oil delivery tubes, said fuel oil conduit and said air conduit and connected to said controller for detecting the internal fuel oil pressure, causing a pressure signal to be sent by the controller for controlling the pump.

* * * * *